US006674349B1

(12) United States Patent
Bolongeat et al.

(10) Patent No.: US 6,674,349 B1
(45) Date of Patent: Jan. 6, 2004

(54) OPENING AND/OR CLOSING CONTROL DEVICE, IN PARTICULAR FOR A SWITCHGEAR APPARATUS SUCH AS A CIRCUIT BREAKER, AND CIRCUIT BREAKER EQUIPPED WITH SUCH A DEVICE

(75) Inventors: Roger Bolongeat, Echirolles (FR); Denis Raphard, Sassenage (FR); Catherine Herault, Claix (FR)

(73) Assignee: Schneider Electric Industries SA (FR)

( * ) Notice: Subject to any disclaimer, the term of this patent is extended or adjusted under 35 U.S.C. 154(b) by 0 days.

(21) Appl. No.: 09/959,663

(22) PCT Filed: Mar. 15, 2000

(86) PCT No.: PCT/FR00/00619

§ 371 (c)(1),
(2), (4) Date: Nov. 19, 2001

(87) PCT Pub. No.: WO00/72347

PCT Pub. Date: Nov. 30, 2000

(30) Foreign Application Priority Data

May 20, 1999 (FR) ..... 99 06592

(51) Int. Cl.[7] ..... H01E 7/00
(52) U.S. Cl. ..... 335/229; 310/29; 335/68
(58) Field of Search ..... 310/32; 335/229, 335/220, 68–76

(56) References Cited

U.S. PATENT DOCUMENTS 4,135,119 A 1/1979 Brosens
4,329,672 A 5/1982 Stahl et al.
4,845,424 A 7/1989 Gamble
5,091,616 A * 2/1992 Ramos et al. ..... 218/9
5,099,382 A * 3/1992 Eppinger ..... 361/115
5,912,604 A * 6/1999 Harvey et al. ..... 335/9
6,531,841 B1 * 3/2003 Elli et al. ..... 318/466

FOREIGN PATENT DOCUMENTS

FR 1324466 4/1962

* cited by examiner

*Primary Examiner*—Lincoln Donovan
*Assistant Examiner*—Bernard Rojas
(74) *Attorney, Agent, or Firm*—Parkhurst & Wendel, L.L.P.

(57) ABSTRACT

The device according to the invention comprises an armature mechanically connected to an actuating rod of the contacts of the apparatus and movable in a support block between a rest position and an active position, at least one permanent magnet and at least one winding. The magnet(s) has(have) the function of holding the armature in the rest position whereas the winding(s) has(have) the function of generating, when an opening order occurs due for example to a voltage surge or other (or respectively a closing order), a magnetic field designed to counteract the force of the magnets so as to move the armature to the active position resulting in separation of the contacts (or respectively closing of the contacts). This device is characterized in that the above-mentioned armature is mounted movable in rotation between two stops arranged in the support, said stops respectively bounding the two above-mentioned positions.

11 Claims, 3 Drawing Sheets

OPENING AND/OR CLOSING CONTROL DEVICE, IN PARTICULAR FOR A SWITCHGEAR APPARATUS SUCH AS A CIRCUIT BREAKER, AND CIRCUIT BREAKER EQUIPPED WITH SUCH A DEVICE

BACKGROUND OF THE INVENTION

The present invention relates to an opening and/or closing control device in particular for a switchgear apparatus such as a circuit breaker comprising an armature mechanically connected to an actuating rod of the contacts of the apparatus and movable in a support block between a rest position and an active position, at least one permanent magnet and at least one winding, the magnet(s) being designed to hold the armature in the rest position, and the winding(s) being designed, when an opening order occurs due to a voltage surge or other (or respectively a closing order), to generate a magnetic field designed to counteract the force of the magnets so as to move the armature to the active position resulting in separation of the contacts (or respectively closing of the contacts).

A device is known comprising an armature mounted sliding linearly in a support, two permanent magnets arranged on each side of the sliding axis of the armature and one or more winding(s) fitted around the armature and designed to generate a magnetic field parallel to the above-mentioned sliding axis. It results from this linear movement of the armature that a relatively large air-gap has to be overcome at the beginning of movement of the armature to the active position. This results in a large quantity of energy (ampere-turns) being necessary at the outset to drive the armature.

Furthermore, during its linear movement, the armature tends to move laterally, attempting to place itself in a position in which the field is minimum, which results in frictions being liable to be generated on the bearings which may give rise to large stresses on said bearings.

OBJECT OF THE INVENTION

The present invention solves these problems and proposes a control device of simple design wherein the energy necessary at the outset is reduced and which presents a high efficiency, and also a circuit breaker equipped with such a device.

For this purpose, the object of the present invention is to propose a device of the previously mentioned kind, this device being characterized in that the above-mentioned armature is mounted movable in rotation between two stops arranged in the support, said stops respectively bounding the above-mentioned two positions.

According to a particular embodiment of the invention, the armature comprises a part of elongate shape presenting two opposite ends of arced shape, said part being mounted in rotation around an axis extending perpendicularly to the longitudinal direction of the armature.

According to a particular feature, the device comprises two windings designed to respectively generate when energized two magnetic fields of opposite direction so as to drive the armature in rotation respectively in one direction to perform the opening operation of the contacts and in an opposite direction to perform a closing operation of the contacts.

According to another feature, the two windings are each situated between the two magnets, respectively on one and the other side of the axis so as to be mutually and angularly offset by an angle of about 180°.

The object of the invention is also to provide a circuit breaker comprising the previously mentioned features taken either alone or in combination.

BRIEF DESCRIPTION OF THE DRAWINGS

But other advantages and features will become more clearly apparent from the following detailed description which refers to the accompanying drawings given for example purposes only and in which.

DETAILED DESCRIPTION OF THE PREFERRED EMBODIMENT

In the figures, a control device can be seen designed to perform opening of the contacts of a switchgear apparatus such as a medium voltage circuit breaker placed in an electrical circuit when an electrical fault such as a voltage surge occurs in said circuit.

Figure 1:
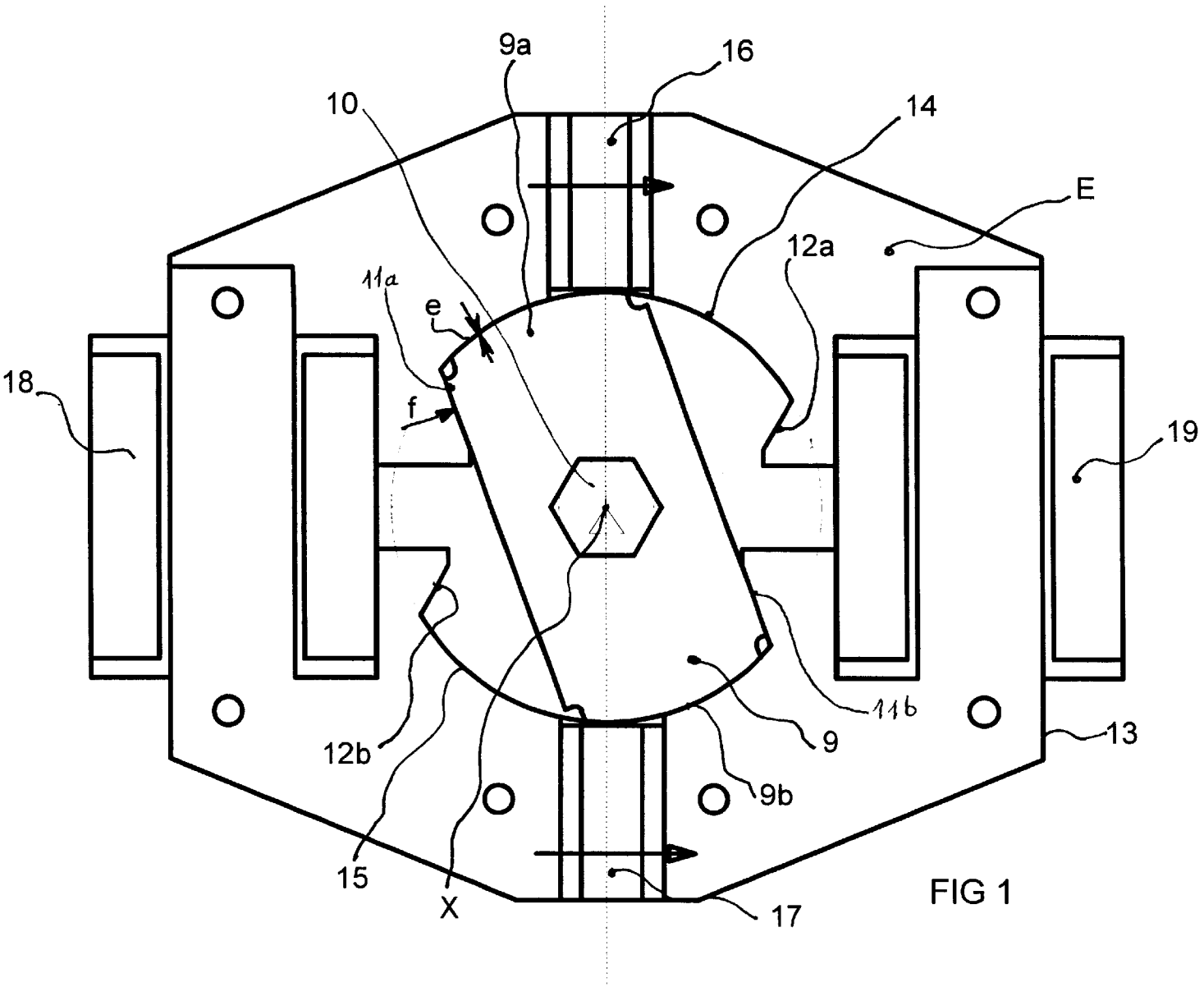
FIG. 1 is a plan view of a control device of a circuit breaker according to the invention, in a rest position corresponding to the closed state of the circuit breaker.
Figure 2:
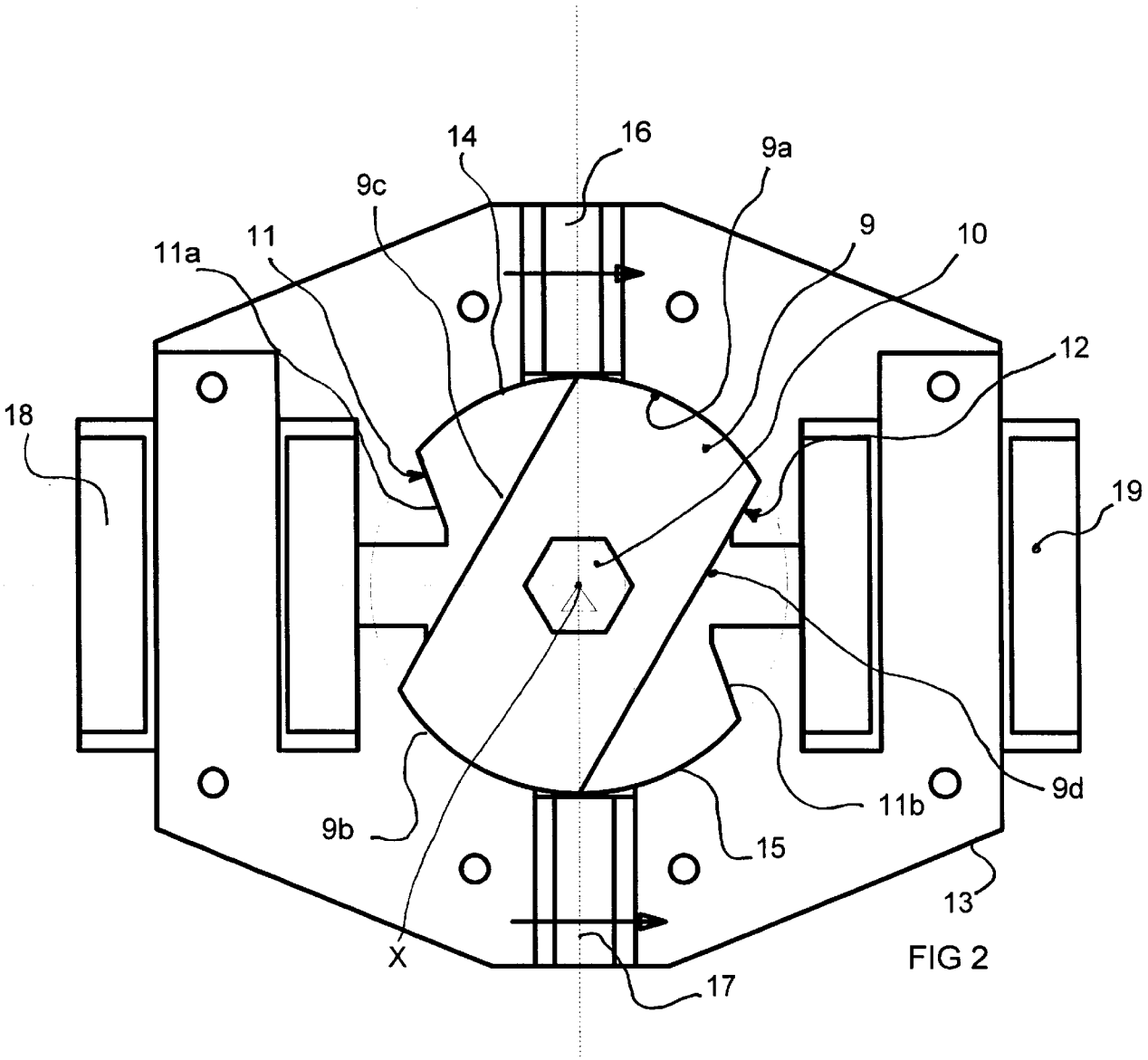
FIG. 2 is a similar view to FIG. 1, in a position of the device corresponding to the open state of the circuit breaker.

In FIGS. 1 and 2, it can be seen that according to the invention the device comprises an armature 9 of general elongate shape presenting two ends of arced shape 9*a*, 9*b* fixedly secured to an actuating rod 10 extending perpendicularly to the longitudinal direction of the armature 9. This armature 9 is mounted free in rotation in a support block 13 between two positions bounded by stops 11, 12 formed in said support 13. The support block 13 therefore comprises for this purpose two surfaces of circular shape 14, 15 for guiding the armature in rotation, arranged in opposite manner with respect to the axis X of rotation of the armature 9 and each extending between the two stops 11, 12, said surfaces being designed to operate in conjunction with the above-mentioned two ends 9*a*, 9*b* of the armature 9. These stops 11, 12 are angularly offset from one another with respect to the axis X of rotation of the armature by an angle of about 50°. The two stops 11, 12 are of complementary shape to the parts 9*c*, 9*d* of the armature 9 designed to be brought into contact with said stops. Each of these stops 11, 12 is formed by two parts 11*a*, 11*b*, 12*a*, 12*b* having the same direction, arranged symmetrically to one another with respect to the axis X of rotation of the armature 9. Two permanent magnets 16, 17 are fitted in this support block 13, being arranged in opposite manner with respect to one another and with respect to said axis X, each one along one of the two above-mentioned guiding surfaces 14, 15, appreciably in the middle of the circumference of these surfaces 14, 15, said magnets 16, 17 then being mutually and angularly offset with respect to the axis X by an angle of about 180°. The direction of magnetization of these magnets 16, 17 is as represented by the arrows of FIGS. 1 and 2. The device comprises in addition two coils 18, 19 each formed by a single winding, said coils 18, 19 being situated on each side of the armature 9 between the guiding surfaces 14, 15 and being offset by an angle of about 180° with respect to one another around the axis X, each of the coils being situated between the two magnets 16, 17. The magnets and coils are thus successively and alternately offset around the axis by an angle of about 90°.

Figures 3, 4:
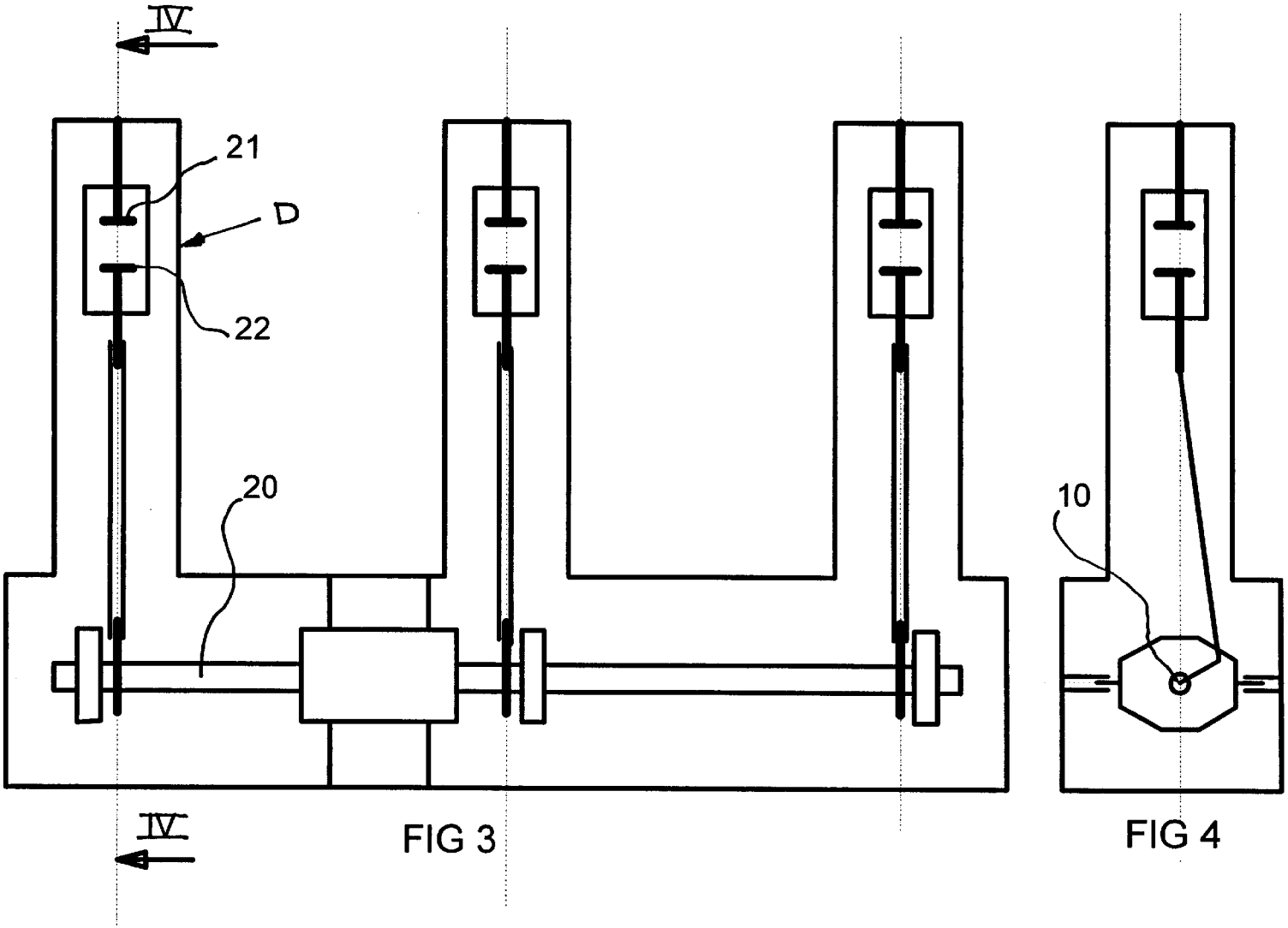
FIG. 3 is a longitudinal sectional view illustrating the device according to the invention implemented to perform control of several circuit breakers.
FIG. 4 is a cross-section view along IV—IV of the device of FIG. 3.

In FIGS. 3 and 4, it can be seen that the actuating rod 10 is mechanically connected directly to the shaft 20 of the circuit breaker.

Operation of the device of the invention will be described briefly in the following with reference to the figures:

In normal operation of the circuit, the device is in the circuit breaker closed position represented in FIG. 1. In this position, the armature 9 is pressing against the first stop 11*a*, 11*b* and is held in this position by the two permanent magnets 16, 17. When an opening order takes place, the energy supplied to the corresponding coil 18 causes energization of the latter until the attraction force of the permanent magnets 16, 17 is less than the force associated to the magnetic field generated by the coil. The armature 9 is then driven clockwise in rotation. At the beginning of this movement, the initial air-gap f is close to zero, the only influencing air-gap e being constant and of low value. This results in the energy necessary at the outset for the armature 9 to come unstuck from the stop 11 being low. Continued movement of the armature 9 in rotation causes a corresponding rotation of the trip rod 10 resulting in opening of the circuit breaker contacts 21, 22 and subsequently opening of the electrical circuit. When the armature 9 comes into contact with the second stop 12 (12*a*, 12*b*), the current flowing through the opening coil 18 is interrupted. In this position of the device, represented in FIG. 2, the armature 9 is held against the second stop 12 by the two permanent magnets 16, 17.

To perform closing of the circuit, a current is sent to the closing coil 19. When the corresponding magnetic field created by the closing coil 19 is greater than the field created by the permanent magnets 16, 17, the armature 9 moves in the opposite direction, i.e. counterclockwise, until it reaches the first stop 11, a position in which it is again held by the permanent magnets 16, 17, represented in FIG. 1.

It should be noted that, although in the previously described embodiment, switching for opening is achieved by one only of the two coils, achieving a device wherein switching for opening is achieved by energization of the two coils connected in series or in parallel can advantageously be envisaged without departing from the scope of the invention.

It should also be noted that the opening order can be provided for example by a deliberate action having the purpose of separating the contacts or directly due to the occurrence of an electrical fault in the circuit.

The value of the closing and opening torques depends on the arrangement of the magnets, that is to say on the direction of their magnetization,. Thus, as is the case in the previously described embodiment, the direction of magnetization can be chosen so that the closing torque is high and the opening torque low (the field of the opening coil being located in the direction of the magnets).

It should be noted that this device can advantageously be used to perform among other things control of vacuum circuit breakers.

An actuator stable in the two limit positions has thus been obtained by means of the invention without power supply of the coils, the electrical energy only being supplied to the coils during movement of the armature.

Achievement of the bistable in rotation leads to all the forces being balanced, resulting in a higher efficiency of the device without too large stresses being generated on the bearings.

The other advantages of the device related to its architecture are as follows:

The actuator can be mounted in rotation directly on the shaft of the device to be operated which enables countershaft returns to be prevented.

Integration of the device in the circuit breaker architecture is facilitated and the overall achievement is simple.

The magnets and the two stops incorporated in the circuit form with the armature a minimum air-gap enabling high holding forces to be achieved between the rotor and the stator without an additional energy source.

It should be noted that the external parts E of the actuator are advantageously achieved such as to limit induced currents.

The invention is naturally in no way limited to the embodiment described and illustrated which has been given for example purposes only.

On the contrary, the invention encompasses all the technical equivalents of the means described as well as combinations thereof in so far as the latter are achieved according to the spirit of the invention.

What is claimed is:

1. An opening and/or closing control device for a switchgear apparatus, the control device comprising:

a support block;

an armature for rotation around an axis extending perpendicularly to a longitudinal direction of the armature, and mechanically connected to an actuating rod of the contacts of the apparatus, said armature having two ends and being movable in said support block between two stops respectively bounding a rest position and an active position;

at least one permanent magnet and at least one winding, the at least one magnet holding the armature in the rest position, and when an opening or closing order occurs, the at least one winding is for generating a magnetic field to counteract a force of the at least one magnet to move the armature to the active position, thereby resulting in movement of the contacts, wherein:

the armature is mounted for rotation between said two stops located in the support, and the support block comprises two guiding surfaces between said two stops for cooperating with said two ends of the armature and for guiding the armature in rotation.

2. The device according to claim 1, wherein the armature comprises a part having an elongate shape with two opposite shaped ends, said part being mounted for rotation around the axis of rotation of the armature.

3. The device according to claim 1, wherein the armature further comprises two first portions located for contact with said stops, and the two stops each have a shape that is complementary to a respective one of said two first portions.

4. The device according claim 1, wherein each of the stops comprises two second portions located symmetrically to each another and with respect to the axis of rotation of the armature.

5. The device according to claim 1, comprising two permanent magnets each located along one of the two guiding surfaces, in opposite manner with respect to one another and with respect to above-mentioned axis of rotation of the armature, and having opposite polarity relative to each other.

6. The device according to claim 5, wherein the two magnets are located substantially in the middle of a circumference defined by the two guiding surfaces.

7. The device according to claim 5, comprising at least one winding located in the support block between the two guiding surfaces, said at least one winding being angularly offset with respect to each of the magnets by an angle of about 90°.

8. The device according to claim 1, comprising two windings for generating two magnetic fields of opposite direction, for driving the armature in rotation in one direction to open contacts of the apparatus and in an opposite direction to close contacts of the apparatus.

9. The device according to claim 8, wherein each of the two windings is located between the two magnets on respective sides of the axis of rotation and mutually and angularly offset by an angle of about 180°.

10. The device according to claim 5, wherein the direction of magnetization of the magnets causes a closing torque of the armature to be greater than an opening torque of the armature.

11. The device according to claim 1, in combination with an attached circuit breaker.

* * * * *